US006866531B2

(12) United States Patent
Hachuda

(10) Patent No.: US 6,866,531 B2
(45) Date of Patent: Mar. 15, 2005

(54) SOCKET FOR ELECTRICAL PARTS

(75) Inventor: Osamu Hachuda, Kawaguchi (JP)

(73) Assignee: Enplas Corporation, Kawaguchi (JP)

( * ) Notice: Subject to any disclaimer, the term of this patent is extended or adjusted under 35 U.S.C. 154(b) by 67 days.

(21) Appl. No.: 10/409,159

(22) Filed: Apr. 9, 2003

(65) Prior Publication Data

US 2003/0194898 A1 Oct. 16, 2003

(30) Foreign Application Priority Data

Apr. 11, 2002 (JP) ..... 2002-109558

(51) Int. Cl.[7] ..... H01R 13/62
(52) U.S. Cl. ..... 439/331; 439/342; 439/259
(58) Field of Search ..... 439/266, 331, 439/259, 342, 366

(56) References Cited

U.S. PATENT DOCUMENTS 5,055,777 A * 10/1991 Bonelli et al. ..... 324/754
5,127,837 A * 7/1992 Shah et al. ..... 439/71
5,320,550 A * 6/1994 Uratsuji et al. ..... 439/266
6,126,467 A * 10/2000 Ohashi ..... 439/266
6,168,449 B1 * 1/2001 Huang et al. ..... 439/259
6,488,522 B2 * 12/2002 Fukunaga ..... 439/331

* cited by examiner

*Primary Examiner*—Briggitte R. Hammond
(74) *Attorney, Agent, or Firm*—Staas & Halsey LLP

(57) ABSTRACT

A socket for an electrical part having a socket body has an electrical part accommodation portion and a contact pin is provided for the socket body so as to be contacted to or separated from a terminal of the electrical part. The contact pin has a contact portion, which projects upward over a through hole formed to the electrical part accommodation portion by a predetermined amount irrespective of an accommodation condition of the electrical part.

10 Claims, 13 Drawing Sheets

SOCKET FOR ELECTRICAL PARTS

BACKGROUND OF THE INVENTION

1. Field of the Invention

The present invention relates to a socket for an electrical part for detachably holding and accommodating an electrical part such as a semiconductor device (called as "IC package" hereinlater).

2. Related Art of the Invention

In a known art, there has been provided an IC socket, as "socket for an electrical part" for detachably holding and accommodating an "IC package" as an electrical part.

Such IC socket has a socket body which is provided with an IC package accommodation portion and to which a number of contact pins are arranged so as to contact the terminals of the IC package to thereby establish an electrical connection.

The socket body is further provided with a floating plate, having the IC package accommodation portion, to be vertically movable, the floating plate being formed with a number of through holes into which contact portions formed to the upper end side of the contact pins are inserted, respectively.

When the floating plate with the IC package being mounted thereon is pressed downward, the contact portions of the contact pins abut against, with predetermined contacting pressure, the terminals arranged to the lower surface of the IC package to there achieve the electrical connection therebetween.

In such conventional structure, however, the contact portions of the contact pins are positioned inside the through holes of the floating plate when the floating plate is positioned at its top dead center, so that the dust or like may invade into the through hole from upper portion thereof and stays in a gap between the contact portion of the contact pin and the terminal of the IC package, which may hence result in defective contact therebetween or constitute a bar for smooth relative movement between the contact portion of the contact pin and the floating plate.

SUMMARY OF THE INVENTION

The present invention conceived to obviate such defects or inconveniences encountered in the prior art mentioned above aims to provide a socket for electrical parts for effectively preventing the dust or like from invading into a through hole into which a contact pin is inserted.

This and other objects can be achieved according to the present invention by providing a socket for an electrical part having a socket body having an electrical part accommodation portion and a contact pin provided for the socket body so as to be contacted to or separated from a terminal of the electrical part, wherein the contact pin has a contact portion, which projects upward over a through hole formed to the electrical part accommodation portion of the socket body irrespective of accommodation condition of the electrical part.

In a preferred embodiment of this aspect, the socket body comprises a base portion and a floating plate disposed above the base plate to be vertically movable with respect thereto, the floating plate being formed with the through hole through which the contact pin is inserted. A plurality of mount projections may be formed on the accommodation portion of the floating plate for mounting the electrical part thereon each with a projection amount being larger than a projection amount of the contact portion of the contact pin at a time when the floating plate is positioned at a top dead center thereof.

More specifically, the present invention provides a socket for an electrical part comprising:

- a socket body having an electrical part accommodation portion;
- a contact pin provided for the socket body and formed with a contact portion to be contacted to or separated from a terminal of the electrical part;
- a pressing member for pressing the electrical part mounted on the accommodation portion of the socket body; and
- an operation member disposed for the socket body to be vertically movable so as to move the pressing member,
- wherein the electrical accommodation portion is formed with a through hole through which the contact portion of the contact pin projects outward by a predetermined amount irrespective of accommodation condition of the electrical part.

According to the above aspects and preferred embodiment of the present invention, the contact portion of the contact pin projects upward over the through hole formed to the electrical part accommodation portion of the socket body irrespective of the accommodation condition thereof. Therefore, any dust or like does not invade and stay in the through hole and a defective contact state between the contact portion of the contact pin and the terminal of the electrical part can be prevented from causing, and furthermore, the contact pin can carry out smooth relative movement in the through hole.

In addition, according to the subject features of the preferred embodiment, in the case where the electrical part is accommodated and mounted on the mount projections at the time when the floating plate of the socket body is positioned at its top dead center, the terminal of the electrical part is free from contacting to the contact portion of the contact pin, thus preventing the electrical part terminal and the contact portion of the contact pin from contacting to each other and being damaged thereby.

The nature and further characteristic features of the present invention will be made more clear from the following descriptions made with reference to the accompanying drawings.

BRIEF DESCRIPTION OF THE DRAWINGS

In the accompanying drawings:

FIG. 12 shows an outside member of a first link according to the described embodiment of the present invention, in which

FIG. 13 shows an inside member of the first link according to the described embodiment of the present invention, in which

FIG. 14 shows a second link according to the described embodiment of the present invention, in which

FIG. 19 shows the IC package, in which

DESCRIPTION OF THE PREFERRED EMBODIMENT

Figure 1:
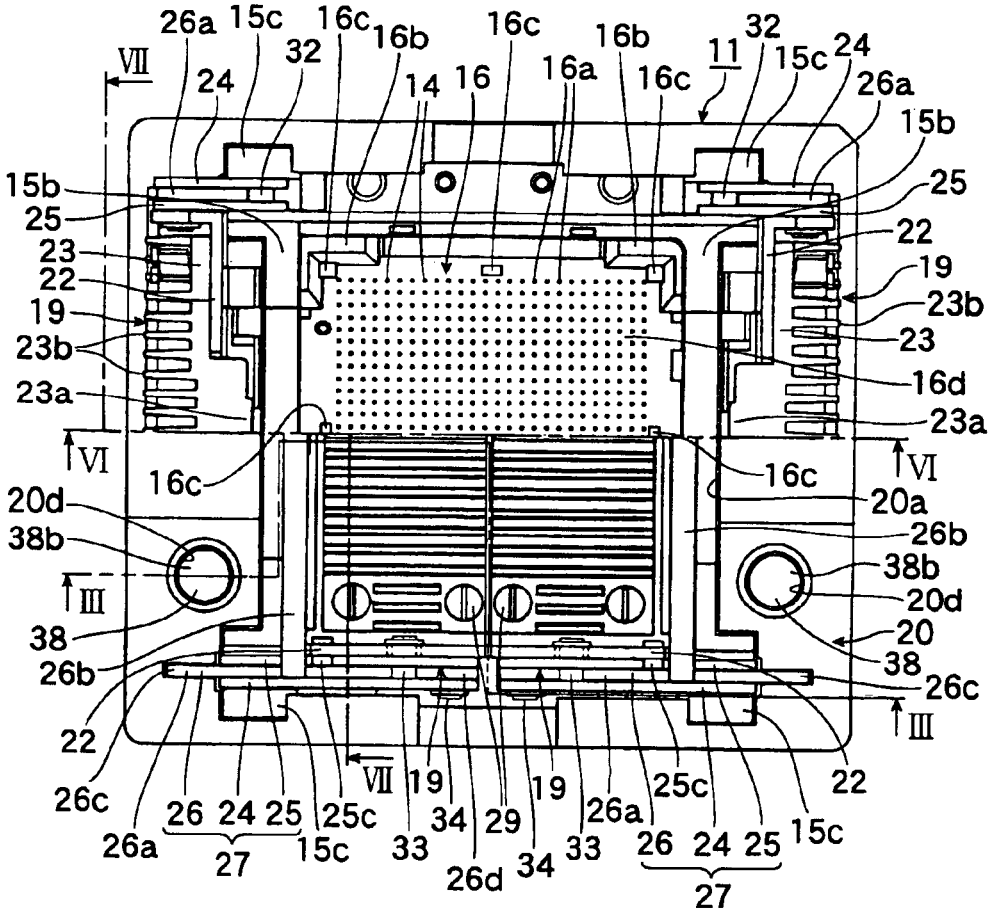
FIG. 1 is a plan view of an IC socket according to one embodiment of the present invention, in which an upper half of a pair of open/close members is opened.

A preferred embodiment of the present invention will be described hereunder with reference to the accompanying drawings of FIGS. 1 to 19. Further, it is first to be noted that terms "right", "left", "upper", "lower" and the like are used herein with reference to the illustrated state on the drawings or in a generally using state of the socket of this kind.

With reference to FIGS. 1 to 19, reference numeral 11 denotes an IC socket as "a socket for an electrical part", which is a socket for establishing an electrical connection between a terminal 12*b* in form of plate of an IC package 12 as "an electrical part" and a printed circuit board, not shown, of a measuring device such as tester, for carrying out a performance test of the IC package 12.

Figure 19A:
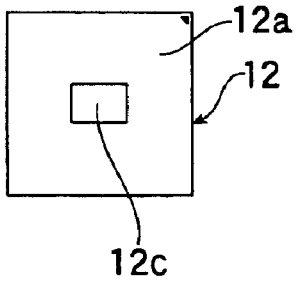
FIG. 19A is a plan view of the IC package.
Figure 19B:
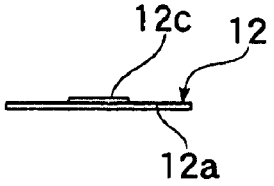
FIG. 19B is a front view thereof and FIG. 19C is a bottom-surface view thereof.
Figure 19C:
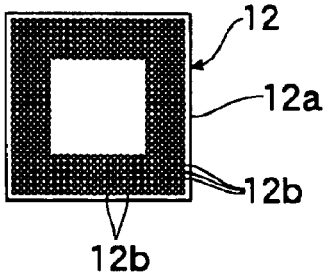

The IC package 12 is so-called an LGA (Land Grid Array) type, such as shown in FIGS. 19A, B, and C, in which terminals 12*b* each in shape of plate are arranged in rows to a lower surface of a square package body 12*a* of the IC package 12. A die 12*c* is formed to the central portion of the upper surface of the package body 12*a* so as to protrude upward as shown in FIG. 19B.

Figure 3:
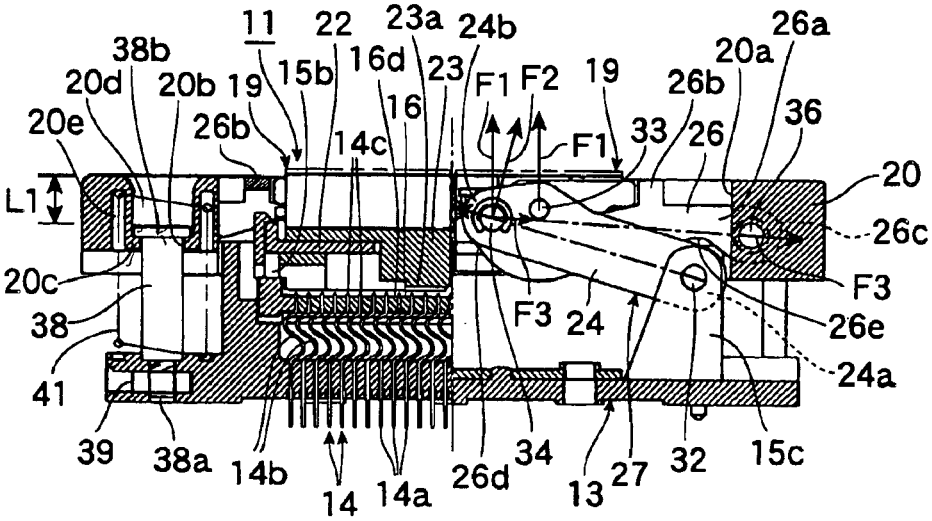
FIG. 3 is a sectional view taken along the line III—III of FIG. 1.

On the other hand, as shown in FIG. 3, the IC socket 11 has a socket body 13 arranged on a printed circuit board, not shown, and this socket body 13 has a base portion 15 to which a number of contact pins 14, contacting the terminals 12*b* of the IC package 12 are disposed and a floating plate 16 disposed on the upper side of the base portion 15.

A pair of open/close members 19 for pressing the IC package 12 are disposed to the socket body 13 to be rotatable, i.e. pivotal, and an operation member 20 in form of square frame is also provided for the socket body 13 to be vertically movable so as to open or close the open/close members 19.

Figure 8:
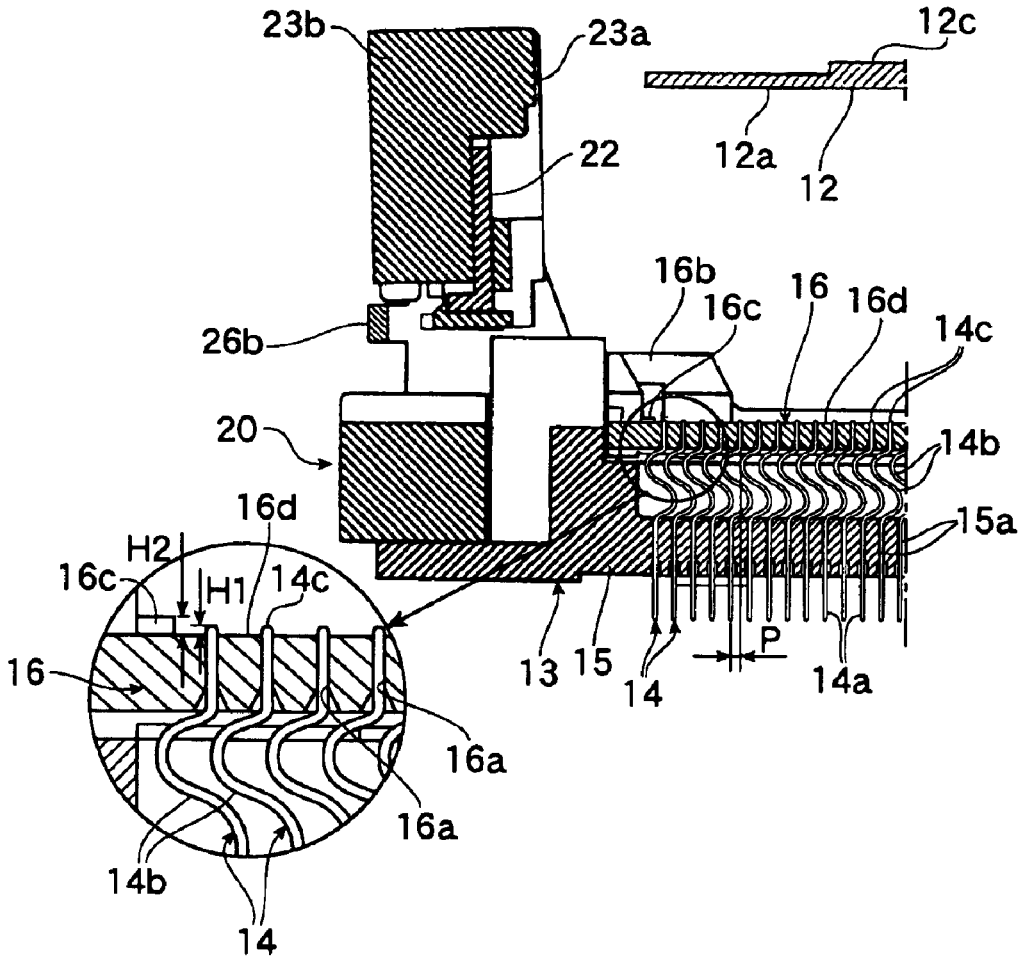
FIG. 8 is a sectional view showing the open/close member which is opened for the explanation of a function of the embodiment of the present invention at an accommodation time of the IC package.
Figure 9:
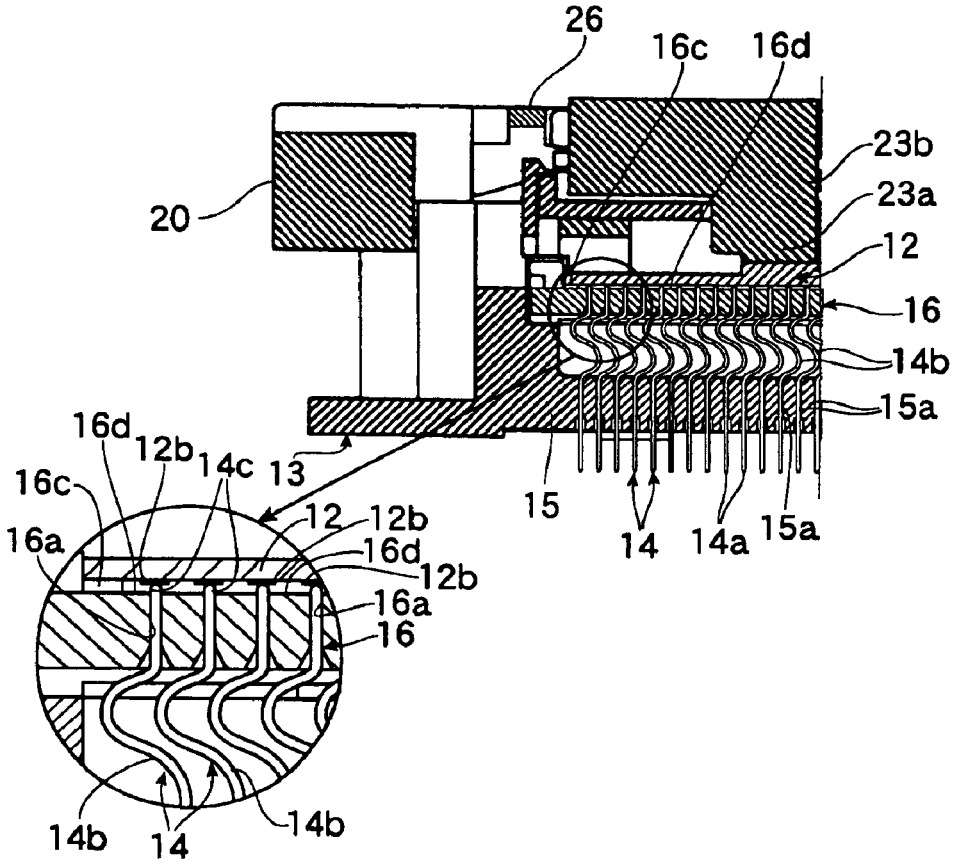
FIG. 9 is a sectional view showing the open/close member which is closed for the explanation of the embodiment of the present invention at the time when the IC package is accommodated.

More in detail, each of the contact pins 14 is formed from a plate member having a springy property and an excellent conductivity as shown in FIGS. 8 and 9. The contact pin 14 is fitted and secured to a press-in hole 15*a* formed to the base portion 15 of the socket body 13, and the contact pin 14 has a lead portion 14*a* which extends downward from the base portion 15 so as to be electrically connected to the printed circuit board. The contact pin 14 is also provided with an elastic (resilient) portion 14*b* formed on the upper side of the lead portion 14*a*. The elastic portion 14*b* has approximately S-shape and elastically deformable property. A contact portion 14*c* is further formed to an upper end portion of the elastic portion 14*b* so as to abut against the IC package terminal 12*b* from the lower side thereof to establish an electrical connection therebetween.

The contact pin 14 is inserted through a through hole 16*a* of the floating plate 16.

Further, it is to be noted that the term "contact pin" and the term "terminal" are used herein at almost all portions equivalently to "contact pins" and "terminals".

This floating plate 16 has a rectangular shape in an outer appearance, as shown in FIG. 1, and has a accommodation surface portion 16*d* on which the IC package 12 is held and accommodated to be vertically movable with respect to the base portion 15 of the socket body 13.

Guide portions 16*b* for guiding the IC package 12 at the accommodation time thereof are formed to the floating plate 16 at portions corresponding to corner portions of the rectangular package body 12*a*. There are also formed projections 16*c* for mounting the IC package 12 at six positions so as to support the IC package through abutment against a peripheral edge portion of the package body 12*a* at an area to which a number of through holes 16*a* are formed in shape of matrix (see FIGS. 1, 8 and 9).

Figure 7:
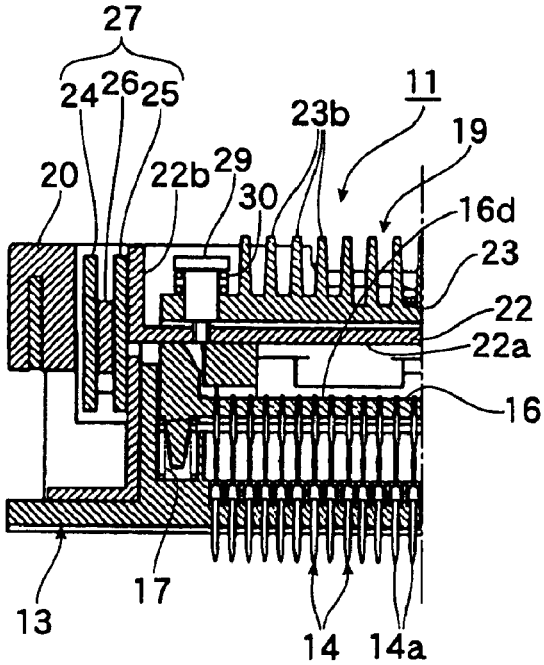
FIG. 7 is a sectional view taken along the line VII—VII of FIG. 1.

Furthermore, the floating plate 16 is disposed to be vertically movable with respect to the base portion 15, and as shown in FIG. 7, is urged upward by means of spring 17 and stopped at a top dead center or position by a stopper portion 15*b* (FIG. 5) formed to the base portion 15 so as to extend upward. The stopper portion 15*b* abuts against the upper surface of a guide portion 16*b* of the floating plate 16.

The guide portion 16*b* is a portion for guiding the IC package 12 at the accommodating operation thereof, the guide portion 16*b* being formed at a portion corresponding to each corner portion of the package body 12*a*. Furthermore, as shown in FIG. 1, 8 or 9, there are also formed projections 16*c* for mounting the IC package 12 at six positions so as to support the IC package through the abutment against a peripheral edge portion of the package body 12*a* at a forming area of a number of through holes 16*a* formed in shape of matrix.

FIG. 8 shows the non-accommodation state of the IC package 12 and FIG. 9 shows the accommodation state thereof. The contact pin 14 is disposed throughout the through hole 16*a* of the floating plate 16 so that the contact portion 14*c* thereof projects upward over the through hole 16*a* irrespective of accommodated state or non-accommodated state of the IC package 12 onto the accommodation surface portion 16*d*.

In the non-accommodated state of the IC package 12, that is, in the top dead center of the floating plate 16, as shown in FIG. 8, a projecting distance H2 of the mount projection 16*c* from the accommodation surface portion 16*d* of the floating plate 16 is made to be larger than a projecting distance H1 of the contact portion 14*c* of the contact pin 14 from the through hole 16*a* of the floating plate 16. Thus, at the top dead center, the contact portion 14*c* of the contact pin 14 does not contact the terminal 12*b* of the IC package 12 in the state that the IC package 12 is mounted on the mount projections 16*c* of the floating plate 16. When the floating plate 16 is depressed downward from the top dead center, the contact portion 14*c* of the contact pin 14 contacts the terminal 12*b* of the IC package 12 as shown in FIG. 9 at a predetermined contacting pressure.

Figure 5:
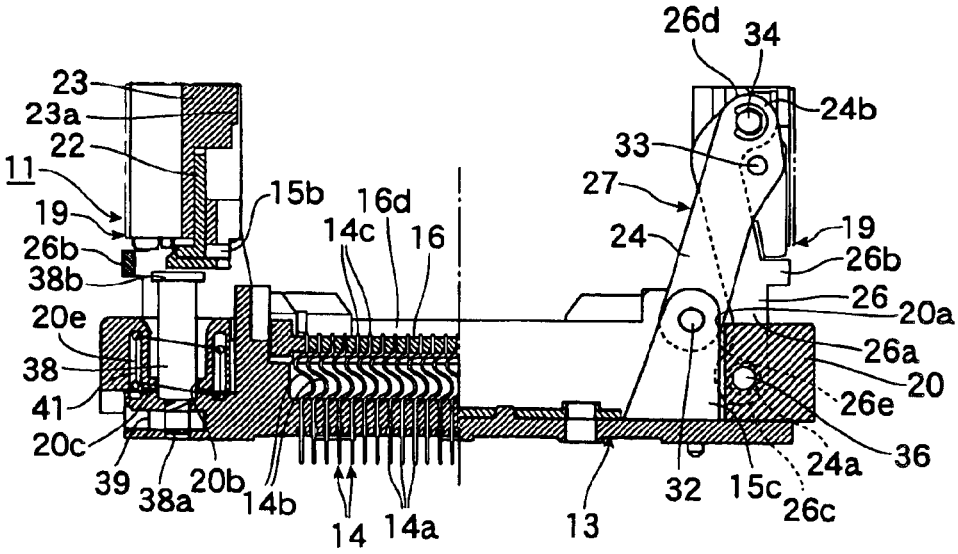
FIG. 5 is a sectional view, corresponding to FIG. 4, showing a state of the operation member moved to the most-downward position.

Further, a pair of open/close members 19 are disposed to be rotatable (i.e. pivotal) in both-side openable manner as shown in FIG. 5, each of the open/close members 19 has a base plate 22 to which a heat sink 23 as a pressing portion or member is formed, which is supported by the socket body 13 through a link mechanism 27 in a manner such that the heat sink 23 is displaced from the pressing position at which it presses the IC package 12 to its retiring or retired position.

Figure 10:
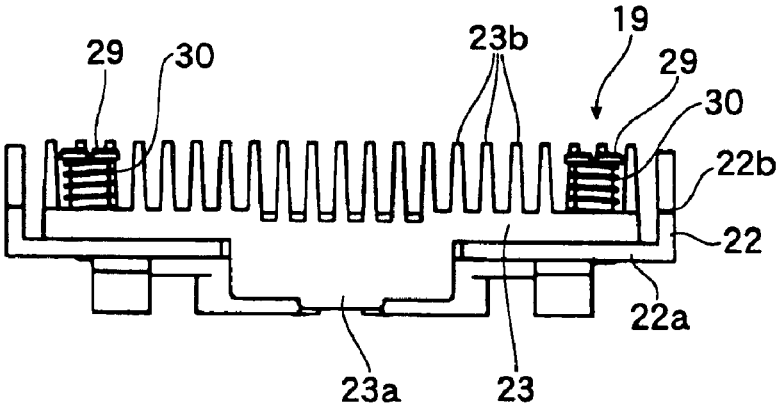
FIG. 10 is a sectional view showing a structural relationship between a base plate and a heat sink of the described embodiment of the present invention.
Figure 11:
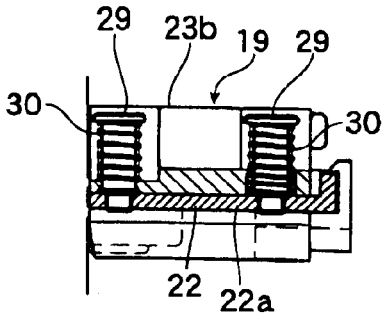
FIG. 11 is a sectional view showing a mounting condition of the base plate and the heat sink.

More specifically, the heat sink 23 is made from an aluminum die-cast having a good heat conductivity, and as shown in FIGS. 1, 10 and 11, the heat sink 23 has one side surface (lower side surface) to which an abutting projection 23*a* is formed so as to abut against the IC package 12 and the other side surface (upper side surface) to which a number of radiation fins 23*b* are formed for effective heat radiation.

The heat sink 23 is mounted to the base plate 22 to be movable in parallel in a perpendicular direction with respect to a plane (flat) surface 22*a* of the base plate 22 under the guidance of four mounting screws 29 screwed with the base plate 22, and the heat sink 23 is urged in a direction abutting the base plate flat surface portion 22*a* by means of coil springs 30 each disposed around the mounting screw 29.

The link mechanism 27 includes a pair of first link including first link outside member 24 and a first link inside member 25 and a second link 26 disposed on both sides of the base plate 22, respectively.

Figure 12A:
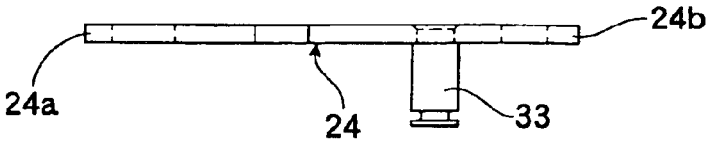
FIG. 12A is a plan view.
Figure 12B:
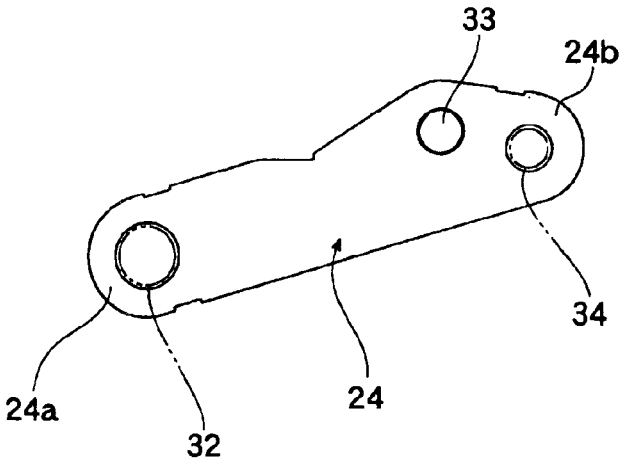
FIG. 12B is a front view and FIG. 12C is a right-side view of FIG. 12B.
Figure 12C:
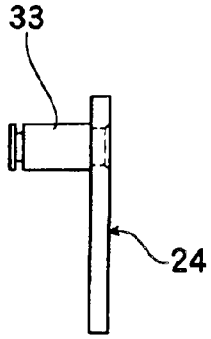
Figure 13A:
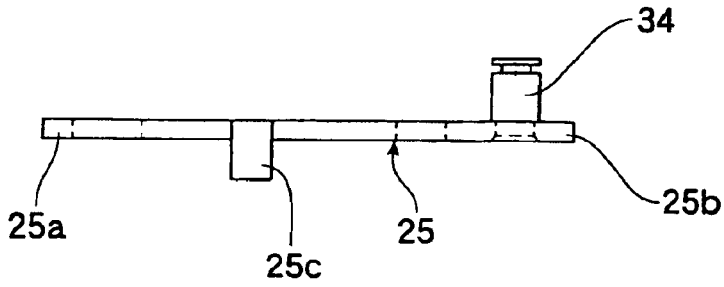
FIG. 13A is a plan view.
Figure 13B:
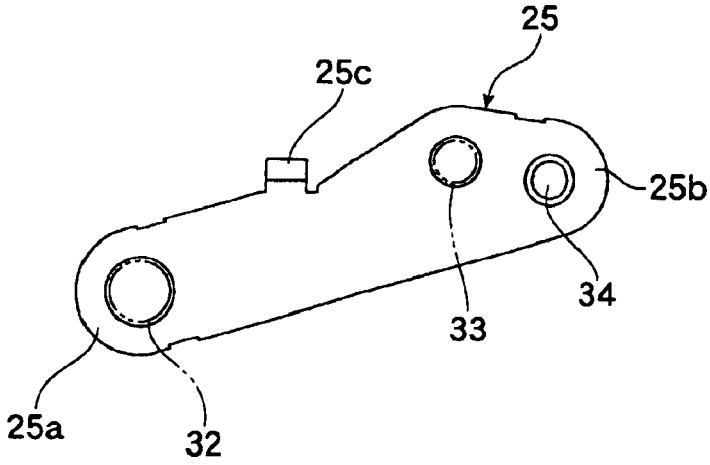
FIG. 13B is a front view and FIG. 13C is a right-side view of FIG. 13B.
Figure 13C:
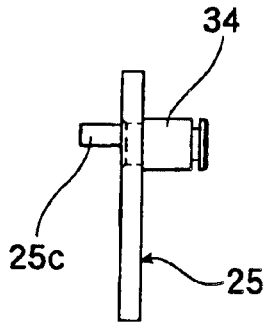

The first link outside member 24 and the first link inside member 25 are formed so as to provide plate shapes as shown in FIGS. 12 (12A, 12B, 12C) and FIGS. 13 (13A, 13B, 13C), respectively, and as shown, one end portions 24*a* and 25*a* of these members are supported to a support post 15*c* projecting from the base portion 15 of the socket body 13 through a support shaft or pin 32 to be vertically rotatable. Further, it is to be noted that the first link outside member 24 and the first link inside member 25 are disposed on both sides of the base plate 22 to be symmetric with each other and only one of them is shown in FIGS. 12 and 13.

Figure 2:
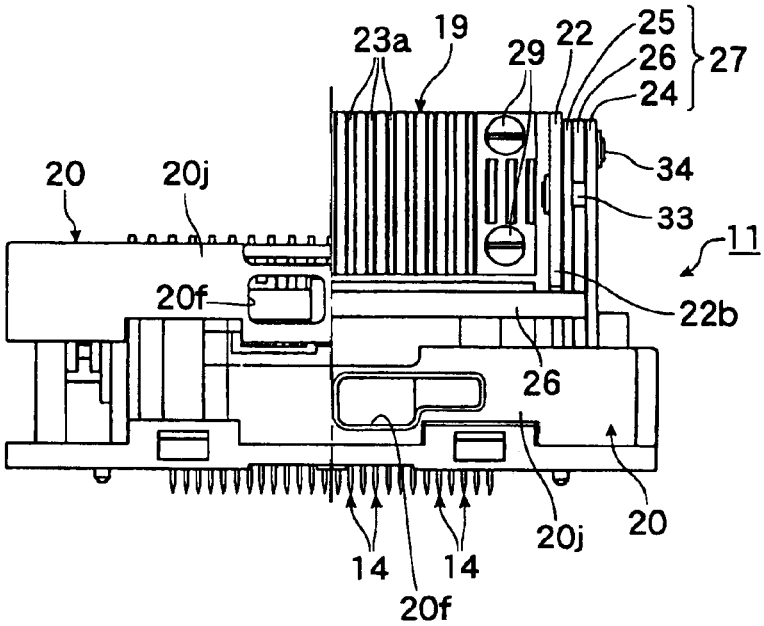
FIG. 2 is a right-side view of the IC socket shown in FIG. 1.

Furthermore, as shown in FIGS. 2 and 3, the other end portions 24*b* and 25*b* or near of the first link outside member 24 and first link inside member 25 are attached to a perpendicular piece 22*b* of the base plate 22 to be rotatable through a mount shaft 33. Further, the first link inside member 25 is fanned with a crooked engaging piece 25c to be engageable with a perpendicular piece 22*b* of the base plate 22 as shown in FIG. 1. According to this engagement, the base plate 22 is prevented from being rotated or pivoted in one direction about the mount shaft 33 with respect to the first link outside member 24 and the first link inside member 25.

Figure 14A:
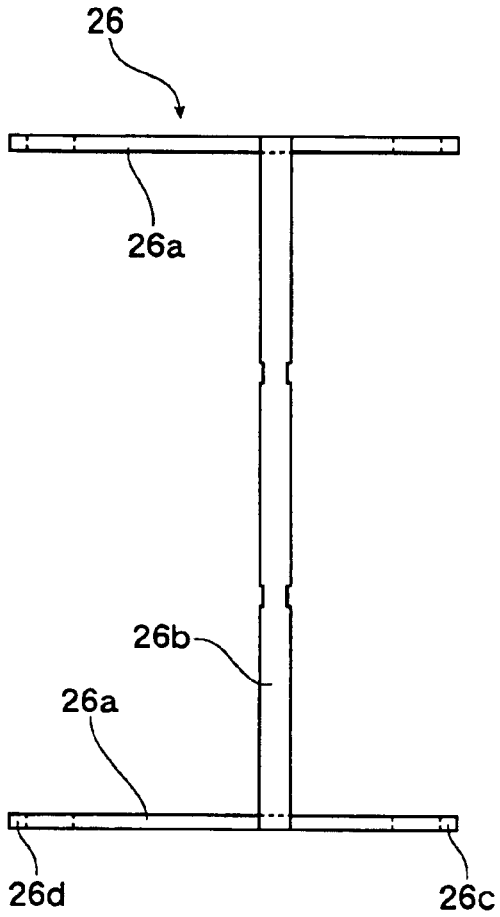
FIG. 14A is a plan view of the second link.
Figure 14B:
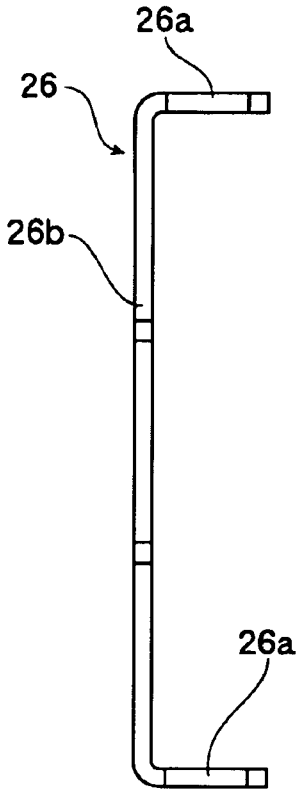
FIG. 14B is a front view thereof and FIG. 14C is a right-side view of FIG. 14A.
Figure 14C:
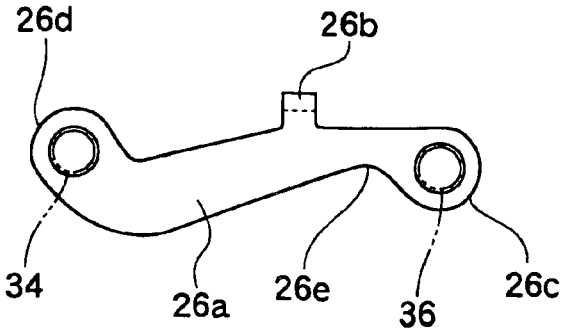

Still furthermore, as shown in FIGS. 14 (14A, 14B, 14C), the second link member 26 is provided with a pair of side plate portions 26*a* disposed on both sides of the heat sink 23 and a connection bridge portion 26*b* in form of long scale plate. These side plate portions 26*a* are disposed in a clamped state between the first link outside and inside members 24 and 25 to thereby keep the parallel arrangement of these members 24 and 25 with a predetermined interval.

The one end 26*c* of the side plate portion 26*a* is mounted, to be rotatable, to the operation member 20 through a power point shaft 36, and the other end 26*d* of the side plate portion 26*a* and the other ends 24*b* and 25*b* of the first link outside and inside members 24 and 25 are coupled to be rotatable to each other through the coupling shaft 34.

According to the structure mentioned above, when the operation member 20 is lowered, in the manner shown in FIG. 5, from the top dead center shown in FIG. 3, the position of the power point shaft 36 is lowered and the lower edge recess 26*e* of the side plate portion 26*a* of the second link 26 abuts against the support shaft 32. Then, the coupling shaft 34 as point of action is rotated upward with the support shaft 32 being fulcrum of lever, whereby the first link outside member 24 and the first link inside member 25 are rotated upward with the support shaft 32 being the center thereof, thus, the base plate 22 and the heat sink 23 are thereby opened upward.

Figure 15:
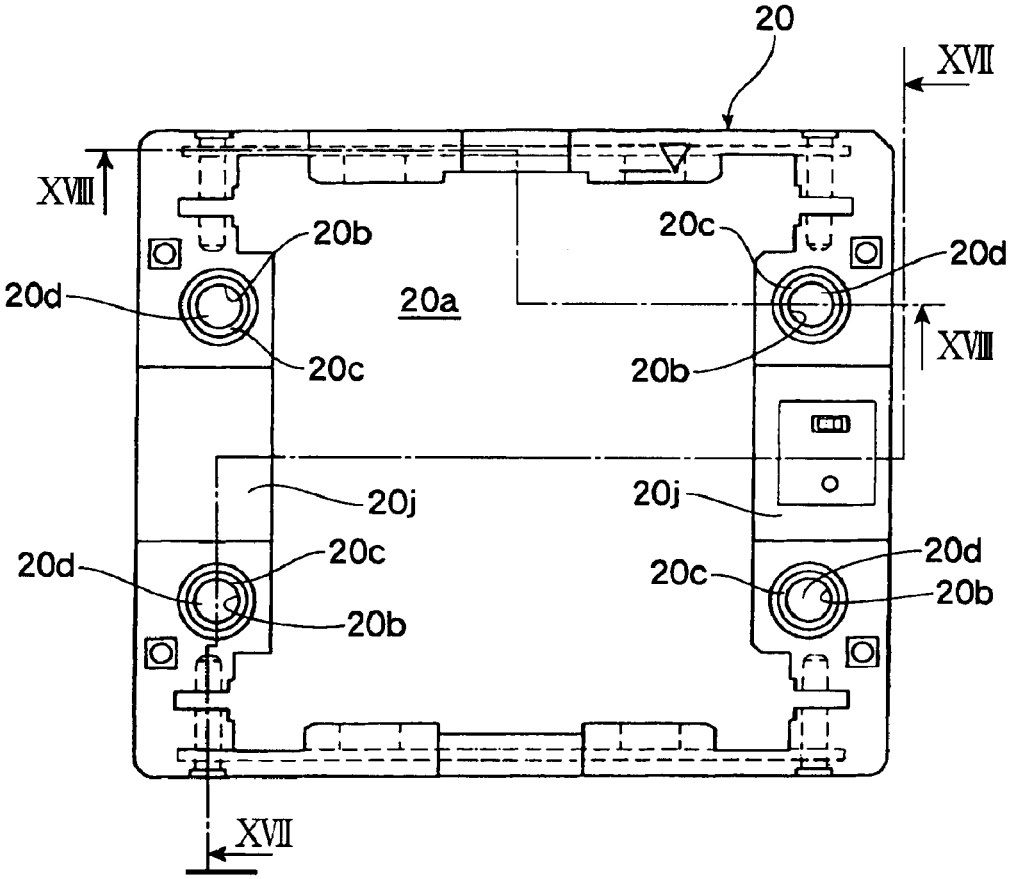
FIG. 15 is a plan view of an operation member for the socket body of the present invention.

On the other hand, the operation member 20 has, as shown in FIG. 15, a rectangular frame shape having a large opening 20*a* through which the IC package 12 can be inserted, and the operation member 20 is disposed to be vertically movable with respect to the socket body 13.

That is, as shown in FIG. 3, the screw portions 38*a* of the four guide pins 38 are screwed and fastened to the nuts 39 provided for the socket body 13, and by inserting these guide pins 38 into the guide holes 20*b* formed to the operation member 20, the operation member 20 is guided by the guide pins 38 to be vertically movable. The operation member 20 is then urged upward by the coil springs 41 disposed around the guide pins 38, respectively, and when moved to the top dead center, the peripheral edge portion 20*c* of the guide hole 20*b* of the operation member 20 abuts against the upper end flanged portion 38*b* of each guide pin 38 to thereby prescribe the upward movement of the operation member 20.

The guide hole 20*b* of the operation member 20 is designed such that it is formed to the bottom surface of its recessed portion 20*d* opened upward for the guide pin 38, and when the operation member 20 is positioned at its top dead center, the upper end flanged portion 38*b* of the guide pin 38 is positioned lower than the upper surface portion of the operation member 20 by a distance L1 as shown in FIG. 3.

Furthermore, an approximately circular ring shape recessed portion 20*c* opened downward for the spring 41 is formed around the recessed portion 20*d* for the guide pin 38 so that the upper end side of the coil spring 41 is fitted into this recessed portion 20*c*. At the top dead center of the operation member 20, the upper end of the coil spring 41 is positioned higher than the upper end flanged portion 38*b* of the guide pin 38 as shown in FIG. 3.

Figure 16:
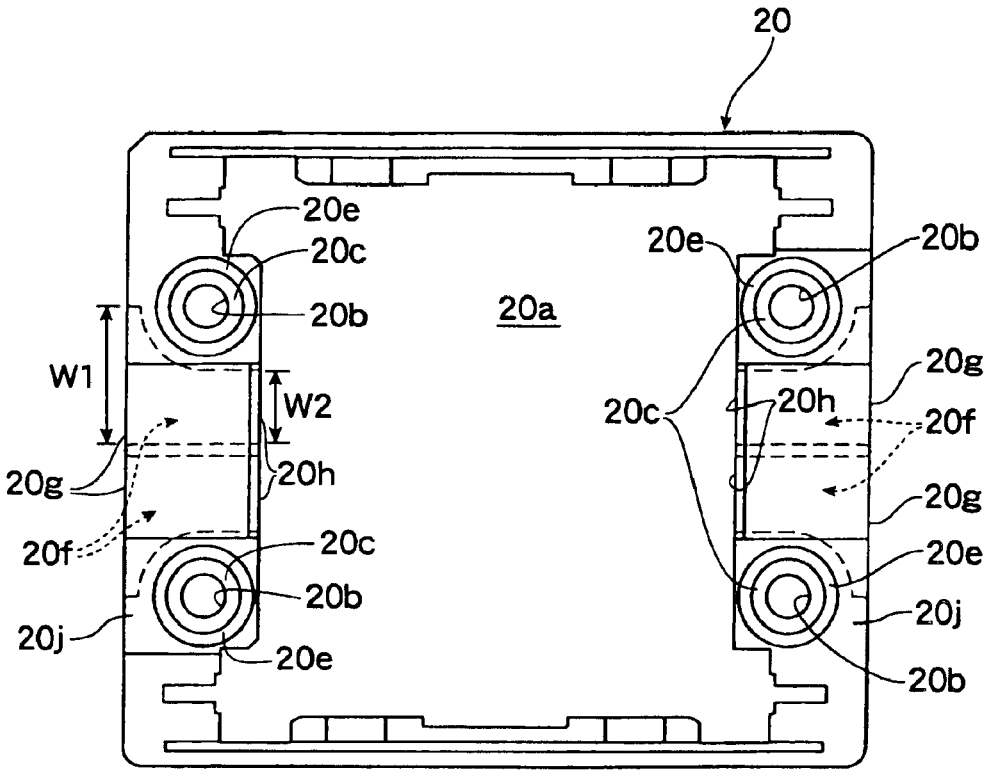
FIG. 16 is a bottom surface view of the operation member.
Figure 17:
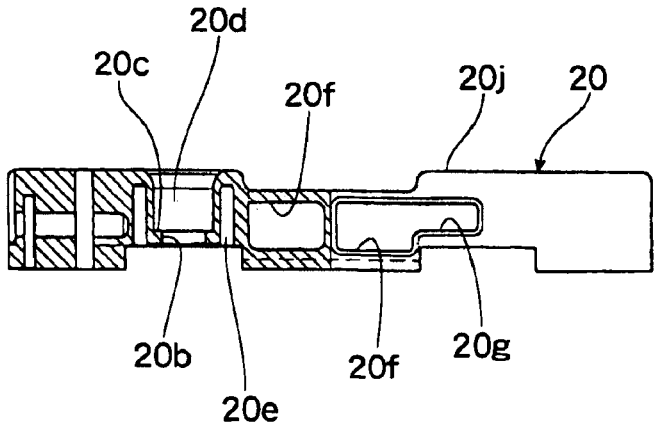
FIG. 17 is a sectional view taken along the line XVII—XVII of FIG. 15.
Figure 18:
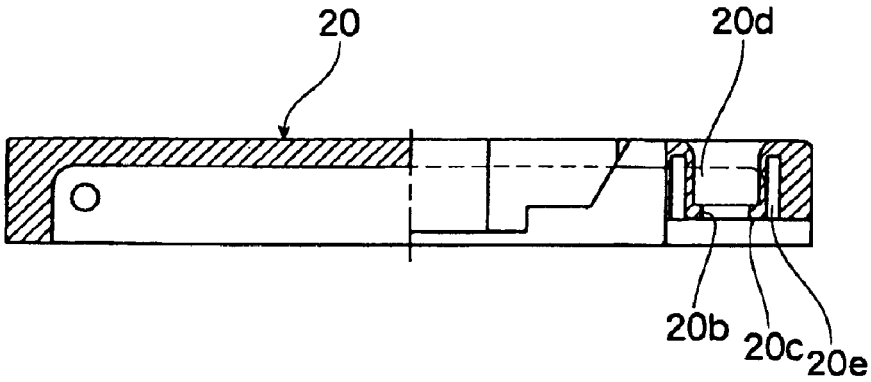
FIG. 18 is a sectional view taken along the line XVIII—XVIII of FIG. 15.

Still furthermore, the operation member 20 is, as shown in FIGS. 2 and 16, provided, at its opposing side portions 20*j*, with two ventilation passages 20*f*, respectively. The paired ventilation passages 20*f* of each side portion 20*j* of the operation member 20 are formed between the paired recessed portions 20*d* for the guide pins 38 in the horizontal direction as viewed in such a manner that an outside opening 20*g* is formed on the outer edge side of the side portion 20*j* and an inside opening 20*h* is formed on the inner edge side of the side portion 20*j*. Each of the outer side openings 20*g* has a width W1 wider than a width W2 of each of the inner side openings 20*h*.

According to such structure as mentioned above, when the open/close member 19 is in the closed state, outside air invading through the outside openings 20*g* of the ventilation passages 20*f* flows inside the operation member 20 and then towards the frame-shape heat sink 23 disposed inside to thereby be exhausted from the inside towards the outside thereof.

The IC package 12 is held and accommodated in the IC socket 11 of the structure mentioned above according to the following manner.

Figure 4:
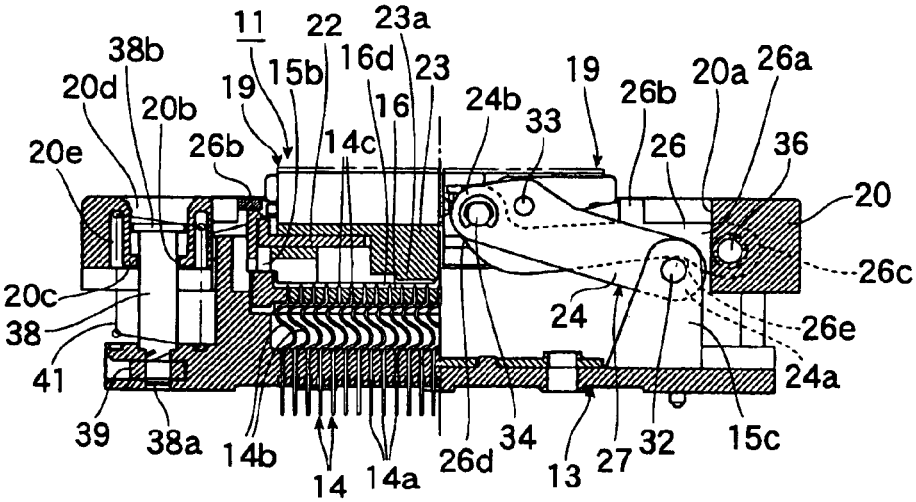
FIG. 4 is a sectional view, corresponding to FIG. 3, showing a state in the way of lowering of an operation member of the IC socket.

First, the operation member 20 is depressed by, for example, an automatic machine, against the urging force of the spring 41. According to this motion, the power point shaft 36 of the operation member 20 is lowered and the second link 26 is rotated downward, and then, the lower end edge recessed portion 26*e* of the second link 26 abuts against the support shaft 32 as shown in FIG. 4.

When the operation member 20 is further depressed from this state, the second link 26 is rotated (pivoted) in accordance with the lever's theory about its support shaft 32, the coupling shaft side is moved upward, the first link outside member 24 and the first link inside member 25 are rotated upward about the support shaft 32, and the base plate 22 and the heat sink 23 are lifted upward through the mount shaft 33, thus being opened as shown in the state of FIG. 5.

At this operation, the depressing force to the operation member 20 is a sum of depressing force to the coil spring 41 and the weight of the heat sink 23 and others. Accordingly, there is no need of additional force against the urging force of the twist coil spring for ensuring the depressing force to the heat sink 23, which is required for the conventional structure, thus easily opening the open/close member 19 with a reduced force.

Furthermore, since the base plate 22 and the heat sink 23 are supported to the mount shaft 33 and the engaging piece 25*c* of the first link inside member 25, the base plate 22 and the heat sink 23 can be prevented from being largely rotated or swung about the mount shaft 33.

Figure 6:
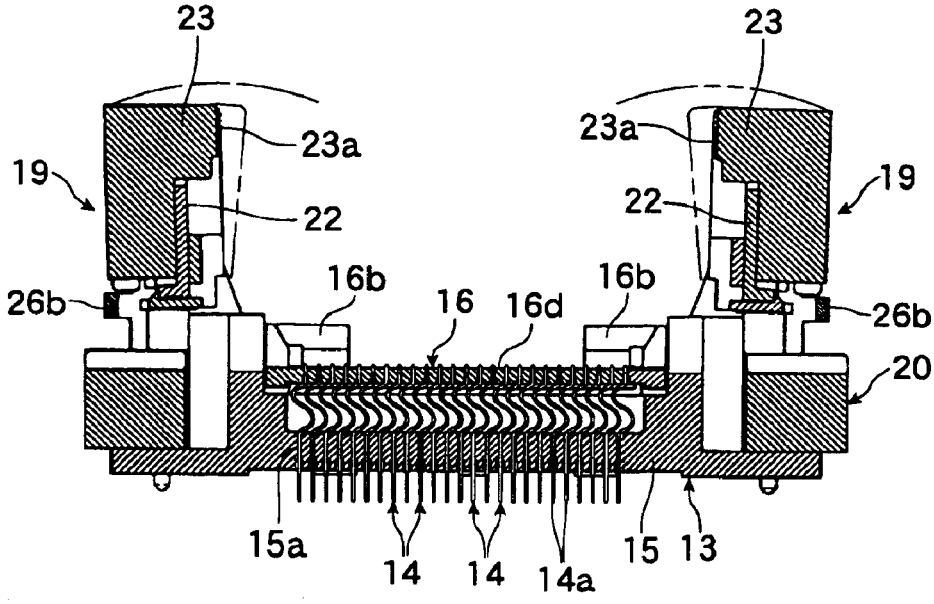
FIG. 6 is a sectional view taken along the line VI—VI of FIG. 1.

In the maximally opened state of the open/close member 19, as shown in FIGS. 5 and 6, the open/close member 19 is positioned so as to extend along substantially perpendicular direction and retired from the insertion range of the IC package 12.

Under such state, as shown in FIG. 8, the IC package 12 is guided on the floating plate 16 under the guidance of the respective guide portions 16*b* and rested on the mount projections 16*c*. When mounted, the projecting amount (length) H2 of the mount projection 16*c* is larger than the projecting amount (length) H1 of the contact portion 14*c*, so that the terminal 12*b* of the IC package 12 does not collide with the contact portion 14*c* of the contact pin 14, and hence, both are not damaged.

Furthermore, since the contact portion 14*c* of the contact pin 14 always projects upward over the through hole 16*a* of the floating plate 16, no dust or like invades into the through hole 16*a*, thus preventing the defective contact between the IC package terminal 12*b* and the contact portion 14*c* of the contact pin 14, and the smooth relative movement of the contact pin 14 with respect to the through hole 16*a* of the floating plate 16 can be realized.

In the next stage, when the depressing force to the operation member 20 is released, the operation member is moved upward by the urging force of the coil spring 41, and accordingly, the open/close member 19 is closed in the manner reverse to that mentioned above and the abutting portion 23*a* of the heat sink 23 abuts against the die 12*c* of the IC package 12 as shown in FIG. 9.

In this operation, the base plate 22 is slightly rotated, i.e., pivoted, about the mount shaft 33. Further, since the heat sink 23 is disposed to be vertically movable, with respect to the base plate 22, by means of mounting screws 29 and the coil spring 30, the package body 12*a* of the IC package 12 can be finely angularly adjusted by the abutment of the abutting projection 23*a* of the heat sink 23 at the time of depressing the package body 12*a* of the IC package 12. Thus, the force can be uniformly distributed under good balanced state.

Moreover, by lowering the floating plate 16 against the urging force of the spring 17, the contact portion 14*c* of the contact pin 14 largely projects over the through hole 16*a* of the floating plate 16 and the contact portion 14*c* abuts against the terminal 12*b* of the IC package 12 as shown in FIG. 9. Under such abutting state, the elastic portion 14*b* of the contact pin 14 is elastically deformed, and according to this elastic force, a predetermined abutting force or pressure can be ensured. At this moment, as shown in FIG. 8, the contact portion side of the front side of the contact pin 14 and the lead portion 14*a* of the root side thereof are positioned with a shifting of half pitch P, so that in the case where the front end of the contact portion 14*c* is depressed downward, this front end does not fall and is displaced to a directly downward position, thus achieving the smooth displacement motion.

Furthermore, the location of the respective link members 24, 25 and 26 makes it possible to ensure the contacting pressure of the contact portion 14*c* of the contact pin 14 to the terminal 12*b* of the IC package 12 without using a twist coil spring having a large urging force.

That is, as shown in FIG. 3, when a force F1 is applied to the heat sink 23 towards the upward direction by the contact pin 14 and the floating plate 16, this force F1 acts on the coupling shaft 34 through the mount shaft 33. Then, a component force F2 of this force F1 acts as a force to rotate the first link outside and inside members 24 and 25 about the support shaft 32. However, in a case that it is attempted to rotate the first link outside and inside members 24 and 25 in the direction of the component force F2 from the state shown in FIG. 3, the second link 26 will act as a strut member and, hence, another force F3 for directing outward the power point shaft 36 is applied.

Further, although this force F3 along the horizontal direction acts for outwardly deforming the operation member 20, it does not act for lowering the operation member. Accordingly, since the second link 26 acts as a strut member without being rotated, the proper contacting pressure or force can be ensured between the terminal 12*b* of the IC package 12 and the contact portion 14*c* of the contact pin 14.

Namely, the location of the link members 24, 25 and 26 makes it possible to reduce the pressing force to the operation member 20 at the time of opening the open/close member 19, and in addition thereto, the contacting pressure between the IC package terminal 12*b* and the contact portion 14*c* of the contact pin 14 can be ensured even in the closing state of the open/close member 19.

Furthermore, the second link 26 is, as shown in FIG. 1, composed of side plate portions 26*a* which are connected through a central bridging portion 26*b*, and accordingly, even if a one-side pressing is applied to the operation member 20, the laterally paired first link outside and inside members 24 and 25 are moved integrally, and the degree of the inclination of the base plate 22 due to such one-side pressing can be largely reduced.

Still furthermore, as shown in FIG. 5, the guide pins 38 can be made shorter, and accordingly, the upper end flanged portions 38*b* of the guide pins 38 do not interfere with the heat sink 23 and other members and the IC socket 12 can be hence made compact, as shown in FIG. 5, even in the state that the operation member 20 is lowered and the open/close members 19 are rotated by about 90 degrees to its perpendicular state.

Still furthermore, as shown in FIG. 3, the coil spring 41 disposed around the thus shortly formed guide pin 38 is set to be long, so that the vertical stroke of the operation member 20 can be made longer, and according to the location of such coil spring 41, upward urging force can be ensured in this long vertical stroke.

In addition, in a case of carrying out a burn-in test by setting an IC package 12 to such IC socket 11, it is necessary to carry out the test under a predetermined temperature. However, in the accommodated condition of the IC package 12, the periphery of the IC package 12 is covered by the frame shaped operation member 20. Accordingly, even in a case that the heat is radiated through the heat sink 23, in a conventional structure, heat inside the operation member 20 is difficult to be radiated, and hence, the inside portion is increased in temperature than the outside of the IC package 12.

According to the present invention, on the other hand, since the two ventilation passages 20*f* are formed to the side portions of the operation member 20, the air circulates between the inside and outside portions of the operation member 20 through these ventilation passages 20*f*. Thus, it becomes possible to examine the IC package 12 with a predetermined temperature condition.

Moreover, these ventilation passages 20*f* are linearly formed, as shown in FIG. 16, to the opposed side portions. 20*j* thereof, and accordingly, the air introduced inside the operation member 20 through the left side ventilation passage 20*f*, for example, is subjected to heat exchanging operation at the IC package accommodated portion and then exhausted outside the IC socket 11 through the right side ventilation passage 20*f*. Accordingly, such good ventilation permits the effective heat radiation of the IC package 12.

Further, it is to be noted that, in the described embodiment, although the present invention is applied to an IC socket as "socket for electrical parts", the present invention is not limited to such socket and is applicable to other devices or like.

What is claimed is:

1. A socket for an electrical part, comprising a socket body, wherein the socket body comprises:

an electrical part accommodation portion, a base portion, a floating plate disposed above the base portion to be vertically movable with respect thereto, the floating plate being formed with a through hole, a contact pin to be contacted to or separated from a terminal of the electrical part, insertable through the through hole, wherein said contact pin has a contact portion, which projects upward over the through hole formed to the electrical part accommodation portion formed to the socket body irrespective of accommodation condition of the electrical part, wherein a plurality of mount projections are formed upward on the accommodation portion of the floating plate for mounting the electrical part thereon each with a projection amount being larger than a projection amount of the contact portion of the contact pin at a time when the floating plate is positioned at a top dead center thereof, and wherein the terminal is not in contact with the contact pin when the electrical Dart is mounted and the floating plate is positioned at the top dead center thereof, the terminal being abutted against the contact pin when the floating plate is depressed from the too dead center thereof.

2. The socket according to claim 1, further comprising a plurality of rotatable members disposed to the socket body pressable against the electrical part.

3. The socket according to claim 1, wherein the contact pin is plate shaped, springy, and electrically conductive.

4. The socket according to claim 1, wherein the contact pin has a lead portion, a S-shaped elastic portion and an upper end portion to abut against the terminal.

5. The socket according to claim 1, wherein the floating plate has a guide portion to guide the pressing of the electrical part.

6. The socket according to claim 1, wherein the base portion has a stopper portion to stop the floating plate.

7. The socket according to claim 1, further comprising an operation member disposed for the socket body to be vertically movable so as to move the pressing member, the operation member having a ventilation passage.

8. The socket according to claim 1, further comprising a openable/closable member having a base plate on which a heat sink is formed or mountable.

9. The socket according to claim 8, further comprising a link mechanism to support the base plate, wherein the link mechanism comprises:

a first link outside member, a first link inside member formed with a first part and a second part substantially perpendicular to the first part to prevent the base plate from being rotated in one direction with respect to the first link outside member, and a second link member.

10. The socket according to claim 9, wherein the second link member has a pair of side plate shaped portions.

* * * * *

UNITED STATES PATENT AND TRADEMARK OFFICE

CERTIFICATE OF CORRECTION

PATENT NO. : 6,866,531 B2
DATED : March 15, 2005
INVENTOR(S) : Osamu Hachuda

It is certified that error appears in the above-identified patent and that said Letters Patent is hereby corrected as shown below:

Column 10,
Line 16, change “Dart” to -- part --.
Line 19, change “too” to -- top --.
Line 52, insert -- , -- after “side”.

Signed and Sealed this

Sixth Day of September, 2005

JON W. DUDAS
*Director of the United States Patent and Trademark Office*